US005337452A

United States Patent [19]

LeBlanc et al.

[11] Patent Number: 5,337,452

[45] Date of Patent: Aug. 16, 1994

[54] SEALED HINGE ARRANGEMENT

[75] Inventors: George LeBlanc, Palm Beach Gardens; Gwyn Gallagher, Jupiter, both of Fla.

[73] Assignee: United Technologies Corporation, Hartford, Conn.

[21] Appl. No.: 75,703

[22] Filed: Jun. 11, 1993

[51] Int. Cl.[5] ..... E05D 3/10; E05D 7/00

[52] U.S. Cl. ..... 16/367; 16/224

[58] Field of Search ..... 16/367, 224

[56] References Cited

U.S. PATENT DOCUMENTS 472,192 4/1892 Loring ..... 16/367
3,036,331 5/1962 Skolnik ..... 16/151
3,404,486 10/1968 Kellerhals ..... 16/224
5,111,550 5/1992 LeBlanc ..... 16/356

FOREIGN PATENT DOCUMENTS 54569 10/1934 Norway ..... 16/367
140329 3/1920 United Kingdom ..... 16/367

*Primary Examiner*—Carmine Cuda
*Attorney, Agent, or Firm*—Edward L. Kochey, Jr.

[57] ABSTRACT

Panels (10, 12, 16, 20) are joined on several hinge axes (14–22, 18–24), and may fold around either axis. A spherical ball (26) fits within a ball receiving socket (28) in the corner of each panel. Sealing against leakage, from one side of the panels to the other, is accomplished at this multiple axis point.

3 Claims, 2 Drawing Sheets

SEALED HINGE ARRANGEMENT

TECHNICAL FIELD

The invention relates to gas tight panels which seal gas on one side of the panels, and in particular to an arrangement where the panels are hinged.

BACKGROUND OF THE INVENTION

It is common to use panels to contain or seal high pressure gas on one side thereof. It is sometimes required that the panels be hinged. When a single hinge or hinge axis is encountered the hinge may easily be sealed.

Occasionally the panel will require two or more hinges where the hinge axes intersect. Only bending around one axis can occur at any one time. The intersection of the two hinge axes, however, presents a seal problem. An alternative is desired to using complex multiple piece seals or tolerating the unwanted leakage in the region of the hinge intersection.

SUMMARY OF THE INVENTION

A plurality of gas tight panels are joined with a plurality of substantially gas tight hinges. There are at least two hinge axis intersecting at a multiple axis point whereby the panel arrangement may rotate or fold around any one of the hinge axes.

At the multiple axis point where the corners of the panels meet there is located a spherical ball which fits within a ball receiving socket in the corner of each panel. The panels are joined by conventional hinge pins whereby the spherical ball is entrapped in sealing contact with the ball receiving sockets.

DESCRIPTION OF THE PREFERRED EMBODIMENT

Figure 1:
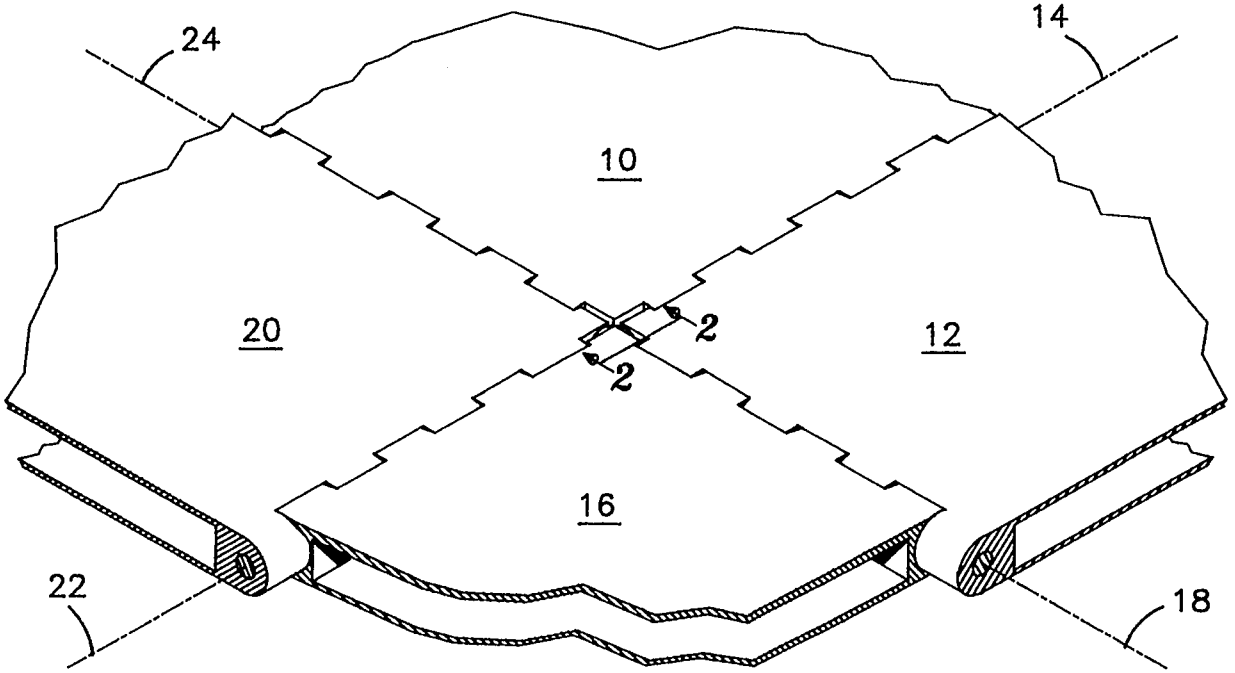
FIG. 1 is an isometric view of the hinged panel arrangement.

In FIG. 1 planar panels 10 and 12 are hinged together on an axis 14. Panels 12 and 16 are hinged on axis 18, while panels 20 and 16 are hinged on axis 22. Planar panel 10 is also hinged to panel 20 on axis 24.

The panels may bend or fold around hinge axis 14 and 22 or hinge axis 18 and 24, but not both at any one time.

High pressure gas is retained on one side of the panel arrangement.

Figure 3:
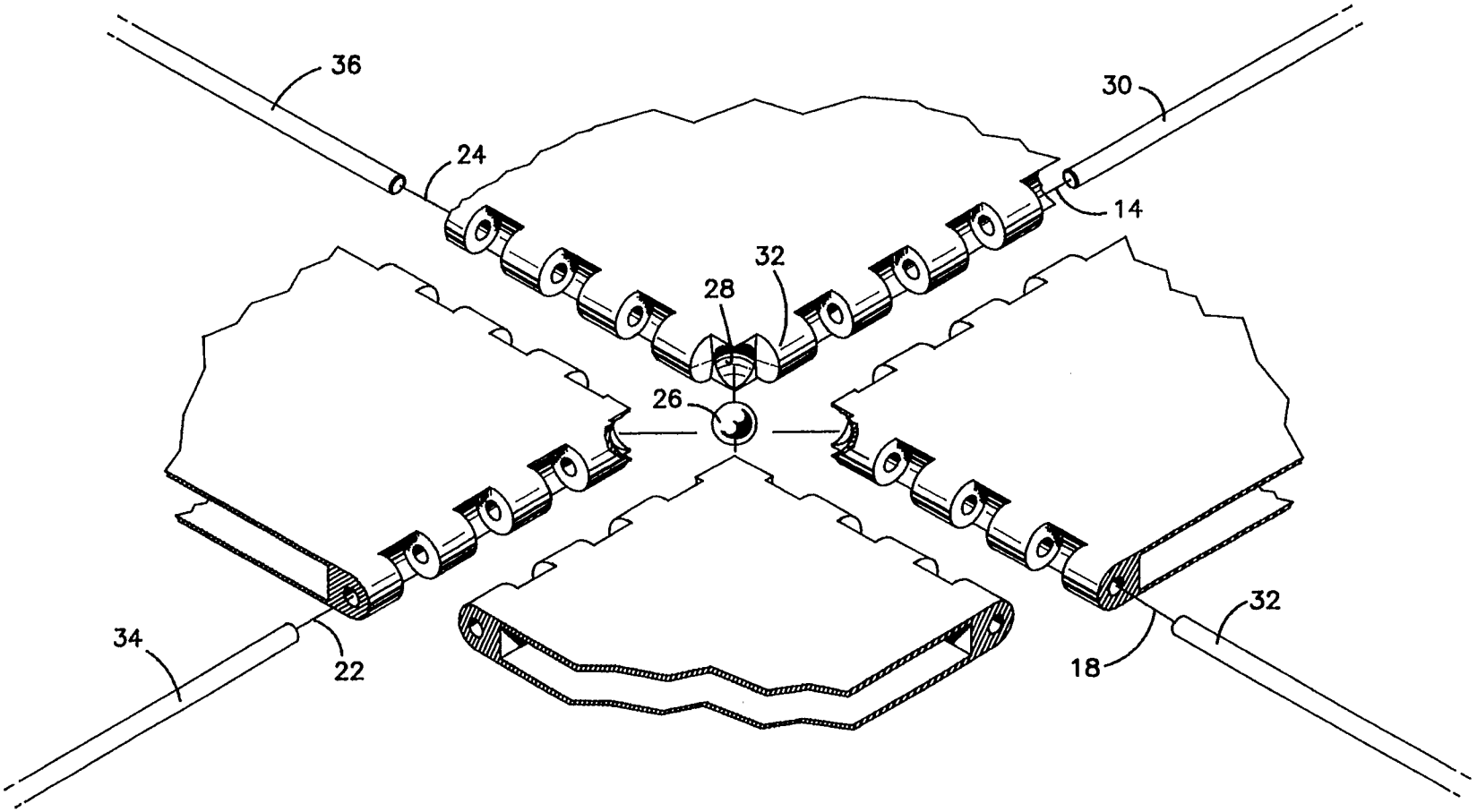
FIG. 3 is an exploded isometric view of the hinged panel arrangement.

FIG. 1 is a section taken through 2—2 of FIG. 1 showing the mating edges of panels 12 and 16 and also a spherical ball 26 located at the multiple axis point where the axes 14, 18, 22, and 24 all intersect. As best shown in FIG. 3 this sphere 26 fits within a ball receiving socket 28 in each of the panels. With the sphere in place between the panels, hinge pin 30 is passed along axis 14 to a location inside boss 32 just short of the spherical ball 26. In a similar manner hinge pin 32 is passed along axis 18 while hinge pin 34 is passed along axis 22. The passage of hinge pin 36 along axis 24 completes the lock-up of the panels entrapping the sphere 26 within the ball receiving sockets. The size of the sphere and the ball receiving socket are controlled so as to maintain sealing contact regardless of the bending and orientation of the panels.

The piano hinge arrangement along each of the axes can readily be sealed between the body of the panel and the hinge boss of the adjacent panel. The sphere will seal the opening at the intersection.

Figure 2:
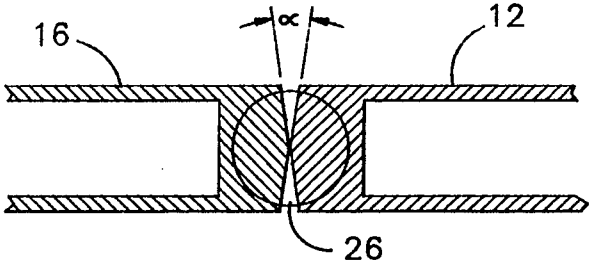
FIG. 2 is a section taken through 2—2 of FIG. 1.

This spherical hinge seal can be used equally well in cases where the hinged panels are not rectangular but are trapezoidal or triangular. As seen in FIG. 2 the edges of the adjoining panels are machined back to form an angle alpha which is consistent with the required bend angle between the panels.

We claim:

1. A hinge arrangement for a substantially gas tight wall, formed of a plurality of panels capable of bending around any one of a plurality of intersecting hinge axes, comprising:

a plurality of substantially gas tight hinges joining said plurality of panels, each hinge having an axis around which adjacent panels rotate;

at least two hinge axes intersecting at a multiple axes point;

a spherical ball located at said multiple axes point;

a ball receiving socket in the corner of each panel contiguous with said spherical ball; and said panels joined at said hinges with said spherical ball entrapped in sealing contact with said ball receiving sockets.

2. An apparatus as in claim 1 further comprising:

each of said plurality of gas tight hinges comprising a piano hinge.

3. An apparatus as in claim 2 wherein:

said plurality of panels comprises four panels; and said hinge axis comprising two hinge axes intersecting at 90°.

* * * * *